US005394613A

United States Patent [19]

Ku

[11] Patent Number: 5,394,613

[45] Date of Patent: Mar. 7, 1995

[54] SPRING-DRIVEN PENCIL SHARPENER

[76] Inventor: Heng-Chun Ku, No.22, Lane 117, Chunghsiao Road, Ping-Cheng, Tao Yuan Hsien,

[21] Appl. No.: 204,088

[22] Filed: Mar. 2, 1994

[51] Int. Cl.[6] ..... B43L 23/02

[52] U.S. Cl. ..... 30/454; 144/28.11

[58] Field of Search ..... 30/451, 453, 454, 457; 144/28.11

[56] References Cited

U.S. PATENT DOCUMENTS

| | | | |
|---|---|---|---|
| 1,242,049 | 10/1917 | Schlichtinger et al. | 144/28.11 |
| 2,188,130 | 1/1940 | Baier et al. | 30/454 |
| 2,439,252 | 9/1948 | Jordan | 144/28.11 |
| 3,134,364 | 5/1964 | Chelazzi | 144/28.11 |

FOREIGN PATENT DOCUMENTS

| | | | |
|---|---|---|---|
| 2035910 | 6/1980 | United Kingdom | 144/28.11 |

*Primary Examiner*—Richard K. Seidel
*Assistant Examiner*—Hwei-Siu Payer
*Attorney, Agent, or Firm*—Steven M. Rabin

[57] ABSTRACT

A spring-driven pencil sharpener is disclosed, including a top cap having a top opening to receive a pencil and two corresponding slots to receive a fastening device including a couple of hollow frames, a housing which is constructed with a pair of coupling castings, each of which being accompanied by a lateral cover, for disposing a pencil blade set and a spring-driven powering device and the outline of the housing is preferably designed to cooperate with that of the cap to form an egg-like shape for being held comfortably as well as looking nice.

14 Claims, 5 Drawing Sheets

SPRING-DRIVEN PENCIL SHARPENER

FIELD OF THE INVENTION

The present invention relates generally to a pencil sharpener and more particularly to a pencil sharpener which is driven by springs.

BACKGROUND OF THE INVENTION

Conventionally, a pencil sharpener is driven electrically or operated manually. For an electric pencil sharpener, the electric power is a necessity to motivate the apparatus. This situation somehow restricts the application of the electric pencil sharpener. For a manual pencil sharpener, it needs a user utilizing both hands to hold the sharpener and operate the sharpening blade at the same time. It may not be easy to handle for children who are usually the most potential users.

SUMMARY OF THE INVENTION

Accordingly, it is a primary object of the present invention to provide a spring-driven pencil sharpener that overcomes the problems of the prior art.

According to the abovementioned object, the present invention provides a spring-driven powering device to perform a pencil sharpening operation. And also, the outline of the present invention is preferably designed to form an egg-like shape for being held comfortably as well as to look nice.

The above object, features and advantages of the invention will become readily apparent from the following detailed description thereof which is to be read in connection with the accompanying drawings.

DETAILED DESCRIPTION OF THE PREFERRED EMBODIMENT

Figure 1:
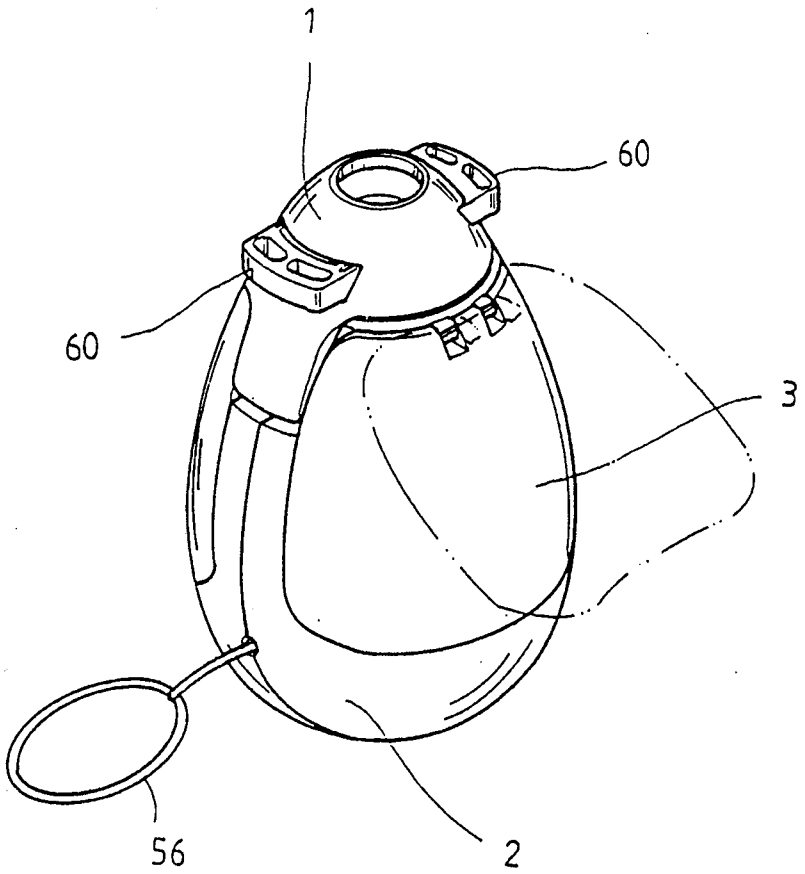
FIG. 1 is a perspective view of a spring-driven pencil sharpener constructed in accordance with the present invention.
Figure 2:
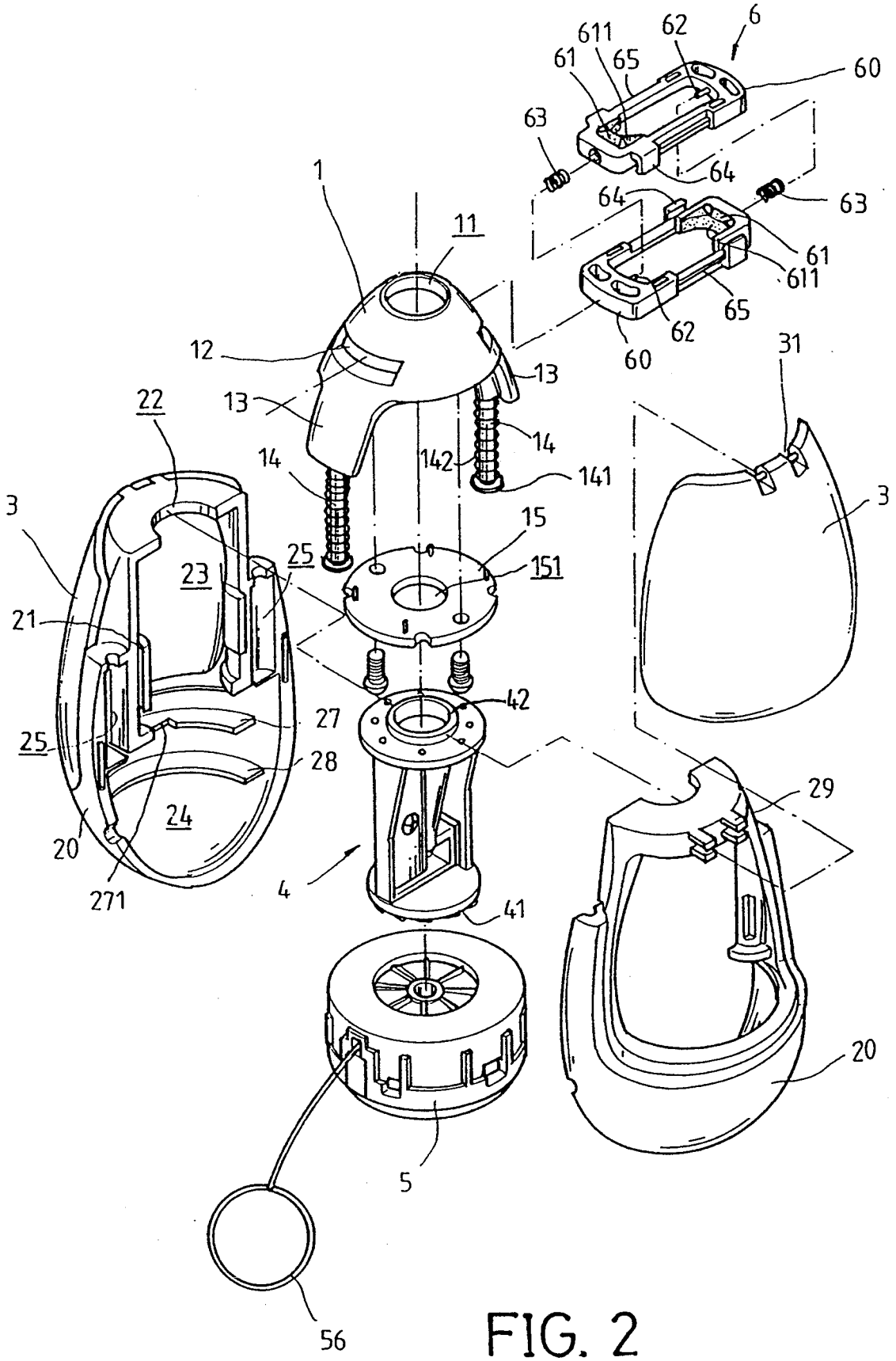
FIG. 2 is an exploded perspective view of the spring-driven pencil sharpener of FIG. 1.

Referring to the drawings and in particular to FIGS. 1 and 2, wherein a spring-driven pencil sharpener assembly constructed in accordance with the present invention is shown, the spring-driven pencil sharpener comprises a top cap 1, a housing 2 which is constructed with a couple of castings 20, each of which is accompanied by a lateral cover 3, a pencil blade set 4 having a radial bevel gear 41 on the bottom thereof and a top opening 42, a spring-driven powering device 5, and a fastening device 6, including a couple of hollow frames 60.

The top cap 1, which is shaped like an airplane nose having an internal space, has a round opening 11 at the top thereof for receiving therein a pencil (not shown), and a pair of slots 12 in two corresponding side walls thereof for receiving therein respectively a portion of each coupling frame 60 of the fastening device 6. The cap 1 further includes a pair of side wings 13 extending downward from the bottom thereof and each of the wings 13 is securely adhered by a post 14 with a flange 141 at a free end thereof to retain a first spring 142 therearound.

Each of the coupling frames 60, which is receivable into a respective one of the slots 12 of the cap 1, includes a retaining block 61. One end of the retaining block 61 is securely adhered to one side of an inner surface of the frame 60. The other end of the retaining block 61 is a semicircular free end 611, whereby the two semicircular free ends 611 of the two retaining blocks 61 form a hole to engagedly receive the pencil. Each coupling frame 60 also has holding post 62 with one end securely adhered to one opposite side of the inner surface of the frame 60 for holding a second spring 63. Each coupling frame 60 further includes a guiding plate 64 and a track 65.

The coupling frames 60 are confined within the internal space of the cap 1 by a bottom cover 15 having a round opening 151 in such a way that one frame serves as a fixed jaw and the other one serves as a movable jaw so that when a user presses both coupling frames 60 inward while each spring 63 reacts against each corresponding frame 60, the movable jaw can slide gently relative to the fixed jaw via the guiding plate 64 moving along the track 65 to enlarge the hole formed by two semicircular free ends 611 of the retaining blocks 61 in order to insert the pencil.

One of the castings 20 of the housing 2 has a pair of locking plates 21 extending from the inner surface thereof to be releasably locked with the other one to form the housing 2, which has a top opening 22 for receiving therein the pencil and internally defining an upper space 23 for disposing therein the pencil blade set 4 and storing pencil cuttings, a lower space 24 for disposing therein the spring-driven powering device 5 and wherein two horizontally parallel plates 27, 28 are mounted to the housing 2 and curve along therewith the upper plate 27 has a centered recess 271 to rotatably lock the powering device 5 and the lower plate 28 is to support the powering device 5 on the bottom thereof, and two side spaces 25 for respectively receiving therein two posts 14 of the side wings 13 of the cap 1. Locking members 29 of each casting 20 pivotally connect to connecting members 31 of the lateral covers 3, so that the covers 3 are swingingly openable in order to clean stored pencil cuttings produced from the blade set 4. And, the outline of the housing 2 is preferably designed to cooperate with that of the cap 1 to form an egg-like shape for being held comfortably as well as to look nice.

Figure 3:
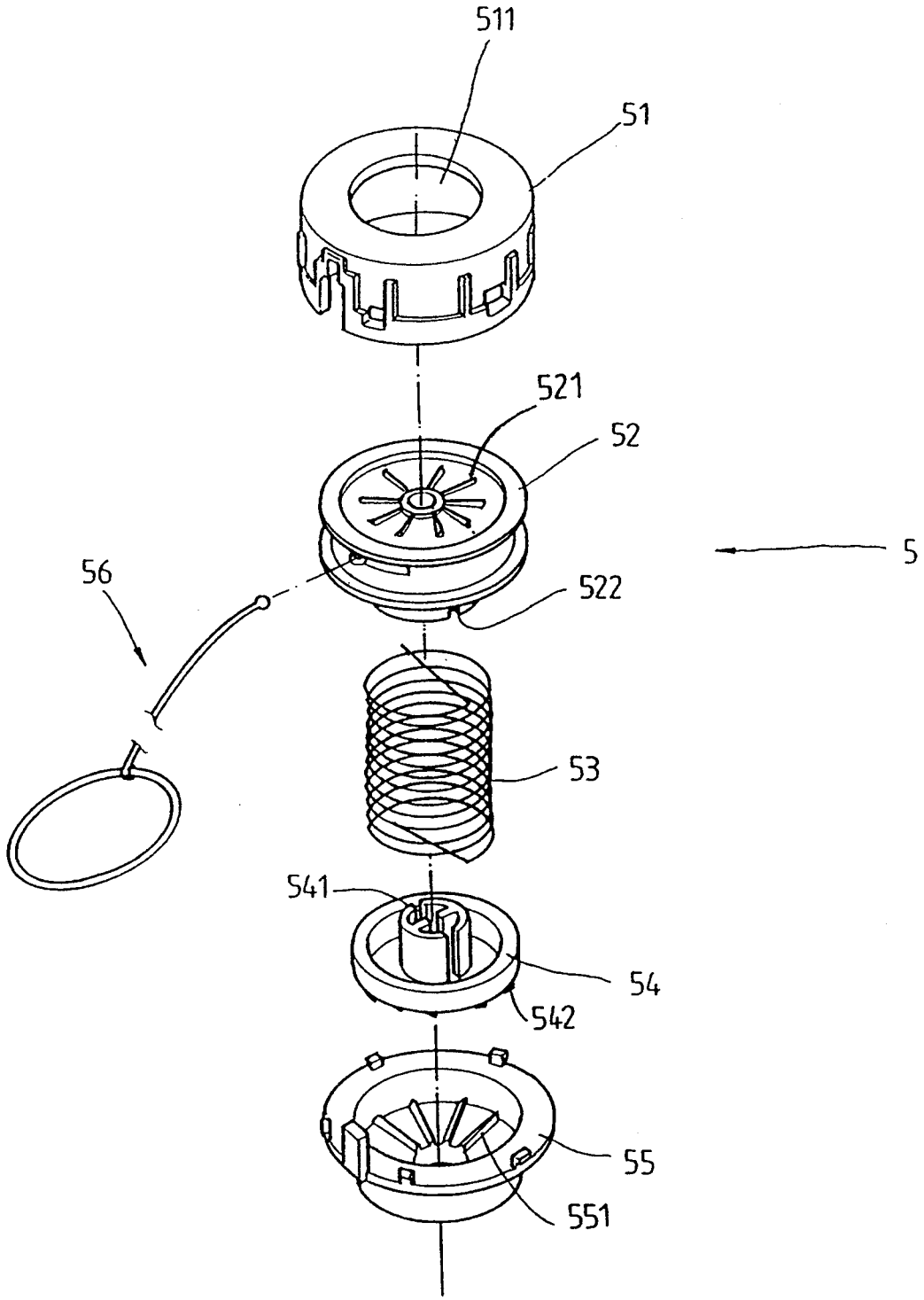
FIG. 3 is an exploded perspective view of a spring-driven powering device of the spring-driven pencil sharpener of the present invention.

Referring to FIGS. 2 and 3, the spring-driven powering device 5 includes a ring-shaped cover 51 having a top opening 511 and a plurality of external lugs, preferably arranged on the circumference thereof, to rotatably lock with the recess 271 of the inner plate 27 within the lower space 24 of the housing 2, a rope-strain reliever 52 having a top radial gear 521, wherein the top opening 511 thereof receives the bottom bevel gear 41 of the blade set 4 and the top radial gear 521 thereof releasably engages with the bottom bevel gear 41 in one side, so as to rotate the blade set 4 in one direction only and a bottom retaining member 522 to retain a third spring 53 at one end thereof, a fixture 54 having a top retaining member 541 extending upward therefrom to retain the other end of the spring 53 and a bottom radial gear 542, a seat 55, which has an internal space to dispose the rope-strain reliever 52, the spring 53 and the fixture 54, the seat 55 also having an inner bottom radial gear 551 to releasably engage with the bottom radial gear 542 of the fixture 54, and a rope 56 which is wound around the rope-strain reliever 52 and tied thereto at one end.

Figure 4:
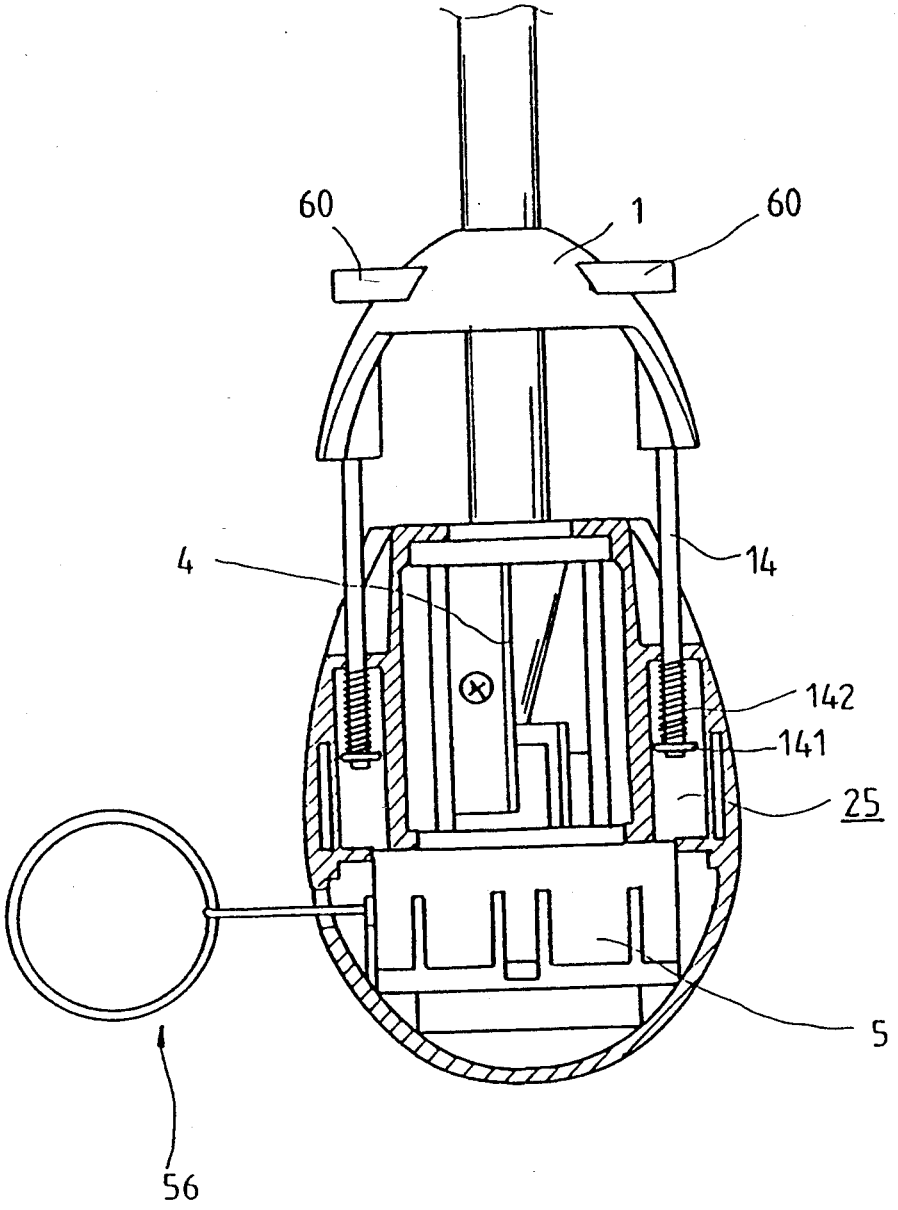
FIG. 4 is a cross-sectional view showing the operation of the spring-driven pencil sharpener of the present invention.
Figure 5:
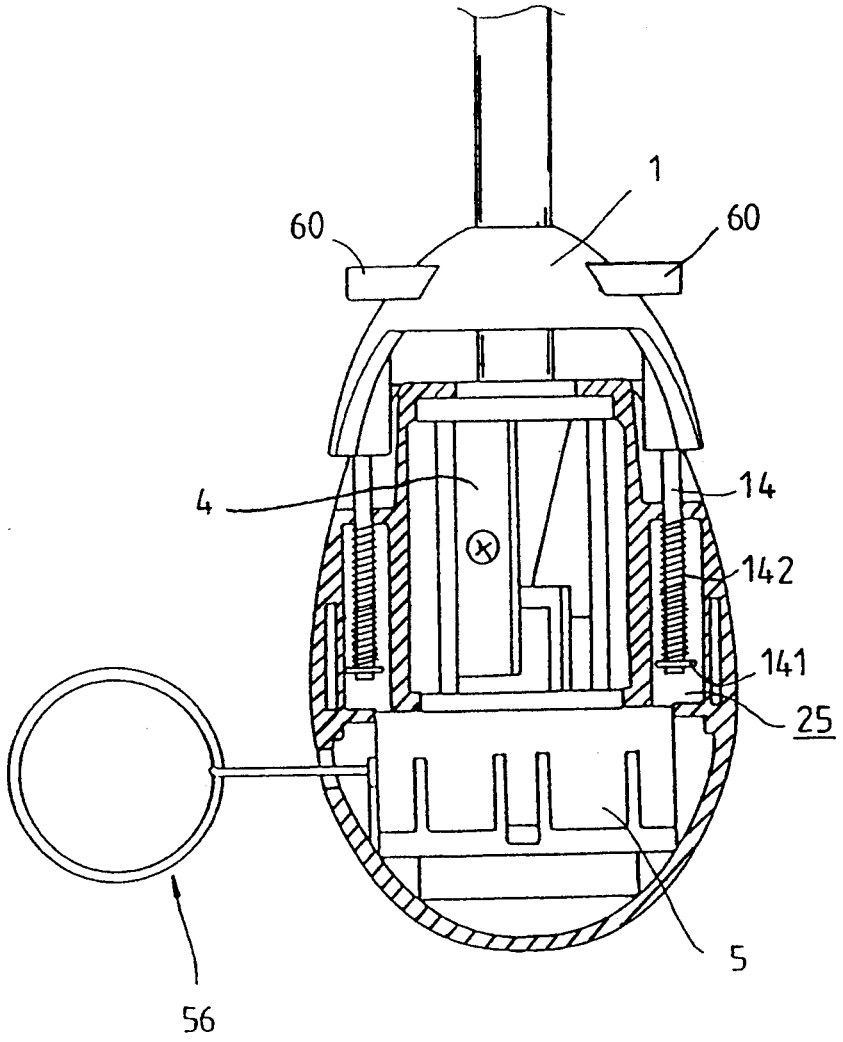
FIG. 5 is a cross-sectional view showing a ready-to-use status of the spring-driven pencil sharpener of the present invention.

FIG. 4 is a cross-sectional view showing the operation of the spring-driven pencil sharpener of the present invention, wherein after pressing the coupling frames 60 and the second springs 63 inward against each other to enlarge the hole formed by two semicircular free ends 611 of the retaining blocks 61, a user inserts the pencil through the opening 11 of the cap 1, next through the opening 151 of the bottom cover 15 and eventually through the opening 42 of the pencil blade set 4, so as to dispose the head of the pencil therein for sharpening and then pull the posts 14 of the side wings 13 of the cap 1 out of the side spaces 25 to compress the first springs 142 which are disposed within the side spaces 25 so as to securely retain the inserted pencil to be a ready-to-use condition as shown in FIG. 5 by way of the flange 141 adhered to the side wall of the side spaces 25° The final step to sharpen the pencil is to pull the rope 56 to rotate the rope-strain reliever 52 so that the third spring 53 is rotatably deformed while the fixture 54 is stationary and the releasable one-side engaging relation between the top radial gear 521 of the rope-strain reliever 52 and the bottom bevel gear 41 of the pencil blade set 4 leads the blade set 4 to rotate in unison with the rope-strain reliever 52. When released, the rope 56 is pulled back to wind around the rope-strain reliever 52 due to the potential energy of the third spring 53 tending to restore its original condition.

Having described the specific preferred embodiment of the present invention with reference to the accompanying drawings, it will be appreciated that the present invention is not limited to that precise embodiment and that various changes and modifications can be effected therein by one of ordinary skill in the art without departing from the scope or spirit of the invention as defined by the appended claim.

What is claimed is:

1. A spring-driven pencil sharpener comprising:

a cap which defines an internal space having a cap opening at the top thereof for receiving a pencil, a pair of slots in two corresponding side walls thereof, a pair of side wings extending downward from the bottom thereof and a pair of posts, each post being securely adhered to said wings respectively and having a flange at a free end thereof to retain a first spring therearound;

a pair of coupling frames receivable within said pair of slots of said cap respectively, each frame including a retaining block having one end securely adhered to one side of an inner surface of the frame and the other end being a semicircular free end, whereby two semicircular free ends form a hole to engagedly receive the pencil, a holding post having one end securely adhered to one opposite side of the inner surface of the frame for holding a second spring, a guiding plate, and a track;

a bottom cover having a bottom cover opening, said bottom cover confining a portion of said pair of frames within the internal space of said cap in such a way that one of said frames serves as a fixed jaw and the other one serves as a movable jaw so that when said coupling frames are pressed inward while each said second spring reacts against each corresponding frame, said movable jaw slides relative to said fixed jaw via the guiding plates moving along the tracks to enlarge said hole formed by said two semicircular free ends of the retaining blocks in order to insert the pencil through said bottom cover opening;

a blade set for sharpening the pencil, said blade set having a blade set top opening and a bottom radial bevel gear;

a spring-driven powering device including a powering device cover having a powering device cover top opening and a plurality of external lugs, a rope-strain reliever having a top radial gear where said powering device cover top opening receives said bottom bevel gear of said blade set, and said top radial gear of said rope-strain reliever releasably engages with said bottom bevel gear of said blade set in one side so as to rotate said blade set in one direction only, and a bottom retaining member extending downward therefrom to retain a third spring at one end thereof, a fixture having a top retaining member extending upward therefrom to retain the other end of said third spring, and a bottom radial gear, a seat which has an internal space for receiving therein said rope-strain reliever, said third spring and said fixture, said seat having an inner bottom radial gear to releasably engage with said bottom radial gear of said fixture, and a rope which is wound around said rope-strain reliever and tied thereto at one end; and a couple of castings, one of which has a pair of locking plates extending from the inner surface thereof to be releasably locked with the other one to form a housing which has a top opening for receiving therein the pencil and internally defining an upper space for disposing therein said blade set and for storing pencil cuttings, a lower space for disposing therein said spring-driven powering device in which two horizontally parallel plates are mounted to said housing and curving along therewith and the upper plate has a centered recess to rotatably lock with said external lugs of said powering device and the lower plate is to support said powering device on the bottom thereof, and two side spaces for respectively disposing therein the first springs, and a locking member pivotally connects a lateral cover to be swingingly openable in order to clean stored pencil cuttings produced from said blade set.

2. A pencil sharpener according to claim 1, wherein lugs are arranged on a circumference of said powering device cover.

3. A spring-driven pencil sharpener, comprising:

a housing having an opening for receiving a pencil;

a blade set, disposed in said housing for sharpening the pencil, said blade set having an upper opening aligned with the opening in said housing for receiving the pencil, and a bottom gear; and a spring-driven powering device, in said housing beneath said blade set, for rotating said blade set to sharpen the pencil, including:

a rope-strain reliever mounted in said housing for rotation in opposite first and second directions, and having a top gear releasably engaging said bottom gear of said blade set so as to rotate said blade set only in said first direction, when the reliever is rotated in the first direction, said reliever also having a bottom spring-retaining member, a spring having opposite first and second ends, said first end retained by said bottom spring-retaining member, a fixture beneath said spring, retaining said second end of said spring, and a rope wound around said reliever, said rope having opposite first and second rope ends, said first rope end being fixed to said reliever, said second rope end being free such that pulling said second rope end away from said reliever rotates said reliever and said blade set therewith, in said first direction against an elastic force of said spring.

4. A pencil sharpener according to claim 3, wherein said powering device further comprises a cover having a top opening through which said top gear of said reliever engages said bottom gear of said blade set, a seat receiving and releasably engaging said fixture to hold said fixture stationary when said reliever rotates.

5. A pencil sharpener according to claim 4, wherein said cover has lugs on a circumferential surface thereof, said housing having a horizontal plate on an interior wall thereof, said plate having a recess for engaging said lugs to lock said cover against rotation, said cover being connected to said seat so that said reliever, said spring and said fixture are retained between said seat and said cover.

6. A pencil sharpener according to claim 3, wherein said bottom gear of said blade set and said top gear of said reliever are radial bevel gears.

7. A pencil sharpener according to claim 6, wherein said spring is a coil spring arranged to be rotatably deformed in the circumferential direction of the coil when the reliever is rotated in the first direction.

8. A pencil sharpener according to claim 7, wherein said powering device further comprises a cover having a top opening through which said top gear of said reliever engages said bottom gear of said blade set, a seat receiving and releasably engaging said fixture to hold said fixture stationary when said reliever rotates, and said cover has lugs on a circumferential surface thereof, said housing having a horizontal plate on an interior wall thereof, said plate having a recess for engaging said lugs to lock said cover against rotation, said cover being connected to said seat so that said reliever, said spring and said fixture are retained between said seat and said cover.

9. A pencil sharpener according to claim 3, wherein said spring is a coil spring arranged to be rotatably deformed in the circumferential direction of the coil when the reliever is rotated in the first direction.

10. A pencil sharpener according to claim 3, wherein said opening in said housing is a first opening, further comprising a cap on said housing, said cap having a second opening aligned with said first opening, for receiving the pencil, said cap having opposing side walls on opposite sides of said second opening and slots in said side walls, said side walls defining an interior space of said cap, a pair of first and second frames, having respective first and second curved surfaces, said frames slidably mounted in said slots so that in a retracted position of said frames, the curved surfaces face each other and define a hole therebetween through which the pencil can be inserted, said frames being spring loaded so as to urge the frames in a direction which closes the hole and engages the pencil therein, and by pushing the frames toward each other against the spring load, the hole is opened to allow insertion or removal of the pencil.

11. A pencil sharpener according to claim 3, wherein said opening in said housing is a first opening, and said spring is a powering device spring, further comprising a cap on said housing, said cap having a second opening aligned with said first opening, for receiving the pencil, said cap having opposing cap side walls on opposite sides of said second opening, a pair of side wings extending downward from said cap side walls, and a pair of posts, respectively secured to said pair of side wings and having flanges at respective free ends thereof, and post springs on said posts retained thereon by said flanges; said housing having two vertically elongated side spaces defined by housing side walls and housing upper walls, said housing upper walls having upper wall openings, said posts extending from said wings through said upper wall openings into said side spaces, said post springs retained in said side spaces between said flanges and said housing upper walls, such that by lifting upward on said cap, said posts are lifted while said post springs are compressed between said flanges and said housing upper walls, and said flanges adhere to said housing side walls.

12. A pencil sharpener according to claim 11, wherein said cap has opposing slots in said cap side walls, said cap side walls defining an interior space of said cap, further comprising a pair of first and second frames, having respective first and second curved surfaces, said frames slidably mounted in said slots so that in a retracted position of said frames, the curved surfaces face each other and define a hole therebetween through which the pencil can be inserted, said frames being spring loaded so as to urge the frames in a direction which closes the hole and engages the pencil therein, and by pushing the frames toward each other against the spring load, the hole is opened to allow insertion or removal of the pencil.

13. A spring-driven pencil sharpener, comprising:

a housing having a housing opening for receiving a pencil and two vertically elongated side spaces defined by housing side walls and housing upper walls, said housing upper walls having upper wall openings;

a blade set, disposed in said housing for sharpening the pencil, said blade set having an upper opening aligned with the housing opening for receiving the pencil;

a spring-driven powering device, in said housing beneath said blade set, for rotating said blade set to sharpen the pencil;

a cap on the housing, said cap having cap side walls which define an internal space, a cap opening at the top thereof aligned with the housing opening for receiving the pencil, a pair of posts, each post being securely adhered to said cap side walls and having a flange at a free end thereof, said posts extending through said upper wall openings into said side spaces, and post springs on said posts, said post springs retained in said side spaces between said flanges and said housing upper walls, such that by lifting upward on said cap, said posts are lifted while said post springs are compressed between said flanges and said housing upper walls, and said flanges adhere to said housing side walls; and means, on said cap and extending into said internal space, for releasably gripping the pencil during the shapening thereof.

14. A spring-driven pencil sharpener according to claim 13, wherein said cap has a pair of opposing slots in said cap side walls, and said means for releasably gripping the pencil comprises a pair of first and second frames, having respective first and second curved surfaces, said frames slidably mounted in said slots so that in a retracted position of said frames, the curved surfaces face each other and define a hole therebetween through which the pencil can be inserted, said frames being spring loaded so as to urge the frames in a direction which closes the hole and engages the pencil therein, and by pushing the frames toward each other against the spring load, the hole is opened to allow insertion or removal of the pencil.

* * * * *